US007216930B2

(12) United States Patent
Steenson

(10) Patent No.: US 7,216,930 B2
(45) Date of Patent: May 15, 2007

(54) ADJUSTABLE ARMCHAIR TRAY

(76) Inventor: Daniel V. Steenson, 1546 N. Ellington Way, Eagle, ID (US) 83616-4080

( * ) Notice: Subject to any disclaimer, the term of this patent is extended or adjusted under 35 U.S.C. 154(b) by 0 days.

(21) Appl. No.: 11/250,654

(22) Filed: Oct. 13, 2005

(65) Prior Publication Data

US 2006/0061155 A1 Mar. 23, 2006

Related U.S. Application Data

(63) Continuation-in-part of application No. 10/921,540, filed on Aug. 18, 2004.

(51) Int. Cl.
*A47B 39/00* (2006.01)

(52) U.S. Cl. ..... 297/161; 297/162; 297/160; 297/188.2; 297/188.18; 297/145

(58) Field of Classification Search ..... 297/160, 297/161, 135, 188.2, 188.18, 157.11, 162; 248/311.2; 108/157.11
See application file for complete search history.

(56) References Cited

U.S. PATENT DOCUMENTS 3,632,162 A 1/1972 Trethaway
4,575,149 A * 3/1986 Forestal et al. ..... 297/145
4,730,869 A 3/1988 Schumacher
5,505,412 A 4/1996 Van Hamme
D378,334 S * 3/1997 Legere ..... D7/620
5,660,432 A 8/1997 Davis
5,909,922 A * 6/1999 Dugas ..... 297/188.18
6,082,270 A * 7/2000 Zerger ..... 108/44
6,264,272 B1 * 7/2001 Jones et al. ..... 297/173
6,314,891 B1 11/2001 Larson
6,827,405 B1 12/2004 Roberts
6,935,683 B1 8/2005 Brown
2005/0116514 A1 * 6/2005 Bufkin ..... 297/161

* cited by examiner

*Primary Examiner*—David R. Dunn
*Assistant Examiner*—Erika Garrett
(74) *Attorney, Agent, or Firm*—Dykas, Shaver & Nipper, LLP

(57) ABSTRACT

A multi-functional adjustable tray that mounts on the arm of a chair to provide a comfortably accessible work surface to support a computer mouse and other devices. The adjustable tray may be easily mounted to either arm of a chair and provides width, length, rotation, and storage adjustments. The adjustable tray includes a generally planar platform and is pivotally connected to an armchair stop supported by adjustable guides secured to the chair arm by a compression element.

19 Claims, 4 Drawing Sheets

ADJUSTABLE ARMCHAIR TRAY

CROSS-REFERENCE TO RELATED APPLICATIONS

This application is a continuation-in-part application which claims the priority date from the utility application entitled ADJUSTABLE ARMCHAIR TRAY filed by Daniel V. Steenson on Aug. 18, 2004 with application Ser. No. 10/921,540, which is pending, and the disclosure of which is incorporated herein by this reference.

FIELD OF THE INVENTION

The present invention generally relates to the field of computer accessories. More particularly, the present invention provides an adjustable tray that may be easily mounted to the arm of a chair to provide a generally planar working surface to support a computer mouse and other accessories, devices and objects.

BACKGROUND OF THE INVENTION

Computers are operated through the use of peripheral systems and devices such as the keyboard and the mouse. These devices enable a user to interact with a computer to input information, make decisions, and carry out various other functions. Direct physical contact with, and therefore close proximity to, these devices are essential to their operation.

However, in most circumstances a computer user works at a desk and leans forward or sideways from a comfortable sitting position to reach a keyboard or mouse on a desk or other flat surface. Reaching for the keyboard or the mouse in this way makes it very difficult to maintain proper posture and operate the computer comfortably. Use of a computer mouse or similar input device on a desktop stresses the back, shoulder and the wrist. For wrist stress and carpal tunnel syndrome, numerous products, such as ergonomically shaped mice and wrist supports, attempt to address the symptoms of this stress without addressing the awkward positioning that often causes strain.

Additionally, persons with debilitating injuries may find that reaching to a desk to use a keyboard, mouse, or other input device, is difficult or painful. Accordingly, there is a need for a surface for supporting an input device that maintains a position so that the user may maintain ergonomically correct posture and wrist position.

SUMMARY OF THE INVENTION

The physical stresses resulting from the awkward positioning and use of an input device on a desktop may be remedied by mounting an adjustable tray to the left or right arm of a chair in order to facilitate the operation of a mouse or other input device as a natural extension of a person's arm from a comfortable seated position. An adjustable tray that can be quickly and efficiently mounted to the arm of a chair may facilitate comfortable use of a computer keyboard on a person's lap without reaching for the mouse, or use of the keyboard on the platform itself, further correcting the hunched forward position of many computer users.

As used herein, the adjustable armchair tray is referred to simply as an adjustable tray. The adjustable tray includes a platform that provides a generally planar working surface particularly suited for operation of a computer mouse, keyboard or other computer peripheral. The platform is rotatably fastened to a chair arm attachment body, which is adjustable to fit various styles, widths, and lengths of chair arms.

The platform also preferably includes retainers around its perimeter to prevent devices from sliding off the platform, and retainers to retain a mouse pad on the platform when the platform is rotated and stored to the side of the chair.

The main components of the chair arm attachment body are an armchair stop, guides and one or more compression elements. The armchair stop supports the platform for use and storage, and connects the platform to the guides that mount on the arm of a chair. The armchair stop preferably defines a groove, cavity or interconnecting groove by which the armchair stop is pivotally connected by a fastener to the platform through one of the slots in the platform. This interconnection allows the platform to slide and rotate within the horizontal plane for use, and within the vertical plane for storage of the platform to the side of a chair.

The chair arm attachment body includes guides for allowing the adjustable tray to be mounted to the chair arm. The manner of compression presents various embodiments of the adjustable tray. In one embodiment, the guides are slidably interconnected to the armchair stop and fixed therein and against the chair arm by at least one securing device. The securing device is preferably a strap with a buckle for easy attachment.

The adjustable tray is preferably adjustable to various sizes of chair arms. The adjustable tray may also include a pad disposed on the platform and retained by a retainer around the periphery of the platform or, one or more discrete pad retainers. Cushioning material may be used on the armchair stop, the plurality of guides, the plurality of vertical guides and the bottom support member to prevent movement of the adjustable tray or marring of the chair during use.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention, which is measured by the claims, nor is it intended to be limiting as to the scope of the invention in any way.

Still other features and advantages of the present invention will become readily apparent to those skilled in this art from the following detailed description wherein only the preferred embodiments of the invention will be described and shown, simply by way of illustration of the best modes contemplated to manifest the invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 1:
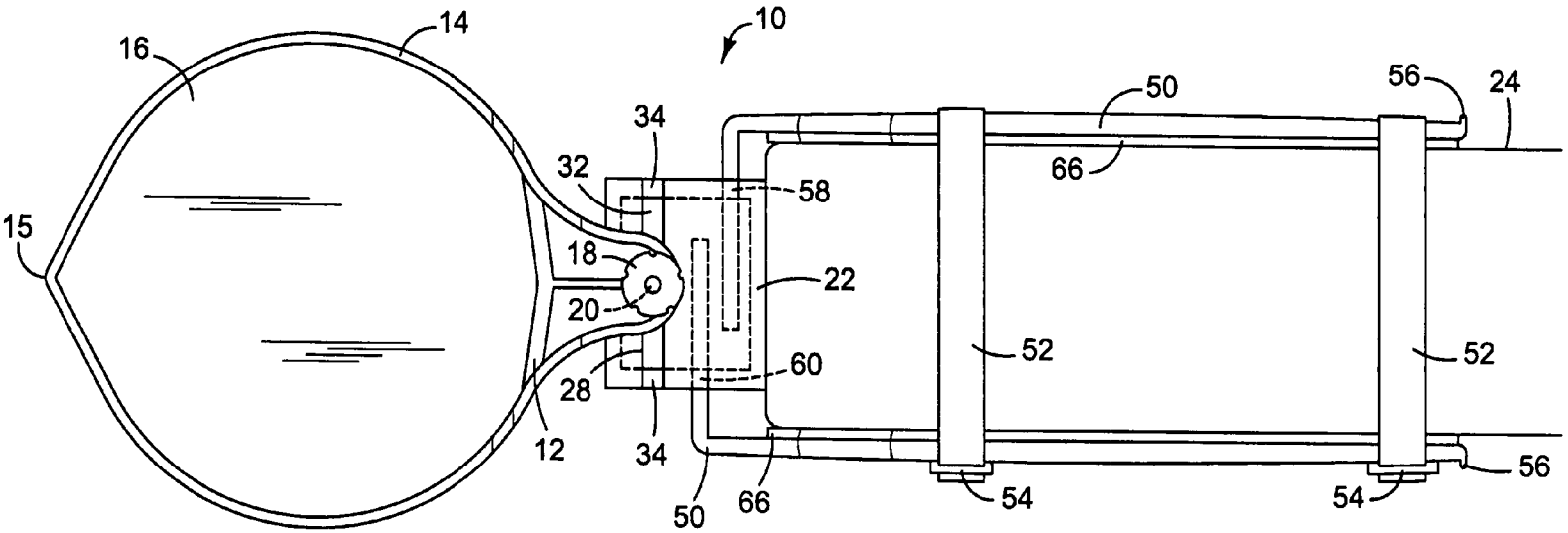
FIG. 1 is a top view of an embodiment of the invention.

While the invention is susceptible to various modifications and alternative constructions, certain illustrated embodiments thereof have been shown in the drawings and will be described below in detail. It should be understood, however, that there is no intention to limit the invention to the specific forms disclosed, but, on the contrary, the invention is to cover all modifications, alternative constructions, and equivalents falling within the spirit and scope of the invention as defined in the claims.

Embodiments of the present invention are adjustable trays that may be mounted on various types of chair arms. Although many different uses are available for the present invention as there are uses for chairs, the present invention will commonly be referenced as an adjustable tray. FIG. 1 shows a top view of an embodiment of the adjustable tray 10. The adjustable tray 10 includes a platform 12, which provides a generally planar surface for devices such as a roller mouse or optical mouse, pen, joystick, keyboard, keypad, roller ball, or similar device. Additionally, the platform 12 may be used to write notes, secure a remote control, hold food or a beverage, or facilitate other similar uses. The adjustable tray 10 may be used on any device or location that is equipped with a chair arm or substantially equivalent structure. For example, many automobile seats are now equipped with armrests that the adjustable tray 10 would easily adapt to fit for the previously mentioned uses.

The chairs to which the adjustable tray 10 may be attached are often mounted on rollers. In normal operation, the user may roll the chair and cause the platform 12 to contact a desk or other external object. To avoid being captured between the external object and the chair arm, the perimeter of the platform 12 may be shaped generally as an oval or an ellipse in some embodiments, and preferably modified by a peak 15. Peak, in this context, means a region of the perimeter that converges more sharply than an oval or ellipse. The overall oval shape of the platform 12 allows the platform 12 to rotate to either side of the chair arm and slide along the object as the object gently pushes it aside. The peak 15 insures that the platform 12 swings to one side or the other, rather than being captured along the long axis of the chair arm. The perimeter of the platform 12 need not be perfectly elliptical; rather, the perimeter of the platform 12 preferably curves smoothly along the sides, and curving more sharply on the end.

The platform 12 and other parts of the adjustable tray 10 may be built or molded of any material that allows for strength and ease of use such as wood, plastic or other similar materials. The platform 12 may incorporate at least one retainer 14, preferably located around the periphery of the platform 12, to allow a mouse, pad, or other device to be retained within the perimeter of the platform 12. The retainer 14 provides a boundary that prevents a mouse, writing utensil, notebook, personal digital assistant, cell phone or other device from falling off the platform 12. In some embodiments, one or more discrete retainers 14 may be placed on all sides of the platform 12 to assure that the mouse does not fall off any side of the platform.

A pad 16 or other similar material may be positioned on top of the platform 12 and configured to be easily replaced when worn out. The pad 16 is preferably made of materials similar to those used for basic stand-alone computer mouse pads, typically neoprene. Additionally, the pad 16 may be rubber, plastic or other material that facilitates the operation of a roller ball mouse, optical mouse or other similar computer-interfacing device. To prevent the pad 16 from falling when the platform 12 is placed in a stored or disengaged position, the mouse pad may be held in place by glue or restraining tabs (not shown) protruding from the retainer 14. In other embodiments, the mouse pad retainers may be a molded part of the platform or clamps, tie downs, hook and loop fasteners, snaps or other elements that could similarly maintain the correct positioning of the mouse pad on the platform 12.

A fastener 18 passes through a hole 20 in the platform 12, pivotally securing the platform 12 to an armchair stop 22. As herein defined, the fastener 18 is a threaded nut and bolt, a pin connection with a threaded end for tightening purposes, or any other element that provides a rotational pivot for the angular adjustment of the platform 12, while still interconnecting the platform 12 with the armchair stop 22. In the embodiment of fastener 18 shown in FIG. 4, the fastener 18 includes a threaded bolt 40. Threaded nut 42 screws onto the shank of bolt 40, capturing the platform 12 between threaded nut 42 and the head 44 of bolt 40. Tightening nut 42 secures platform 12 and prevents it from rotating; loosening nut 42 slightly releases the platform 12 enough to allow rotation to a comfortable position.

The fastener 18 is preferably ergonomically designed or covered so that it does not interfere with the user during use of devices on the adjustable tray 10. This may be accomplished by incorporating a rounded or other shape that allows it to be easily tightened while simultaneously maintaining user comfort. Rounded in this context means that the nut has no sharp edges exposed to the user when installed.

Figure 2:
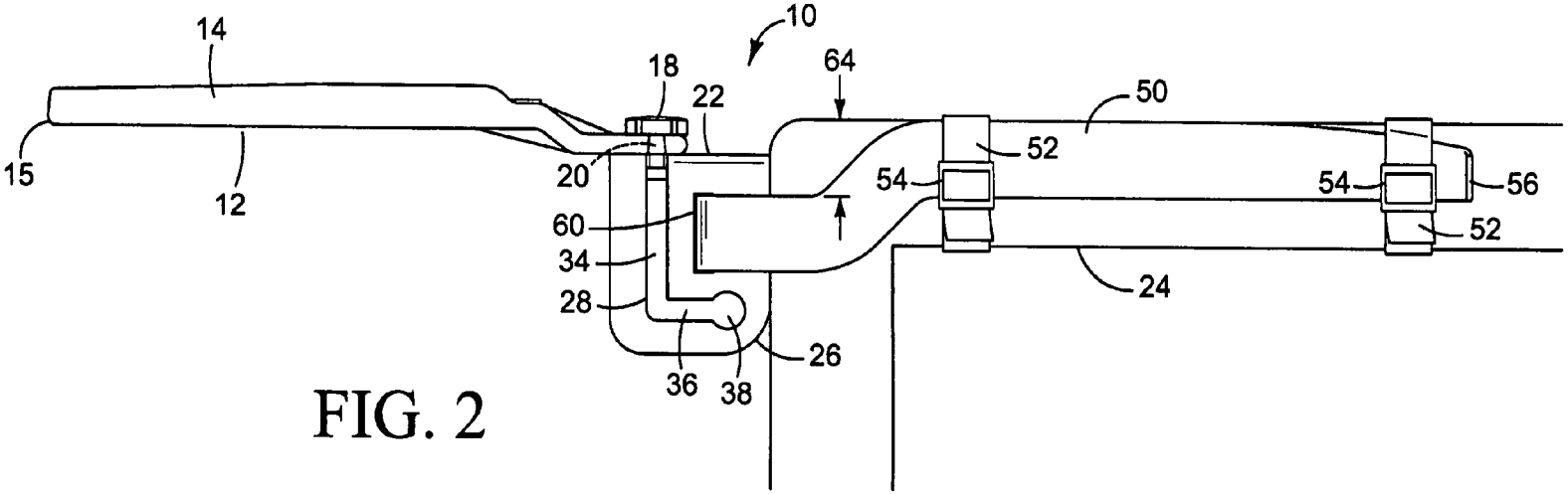
FIG. 2 is a side view of the embodiment of FIG. 1, as mounted on a chair arm.

Referring now to FIG. 2, a side view of the embodiment of FIG. 1, the armchair stop 22 is shaped to be positioned directly against a chair arm 24 while preventing the platform 12 from sliding toward the back of the chair. On some chairs, that position will be where the armrest transitions from horizontal to vertical. The adjustable tray 10 will also work on different styles of arms and chairs with the only general compatibility requirement being that the chair has an armrest equivalent. The armchair stop 22 has a curved or slanted region 26 to accommodate any curvature of chair arm 24. When the region 26 of armchair stop 22 abuts the chair arm 24, the chair arm 24 provides additional support to the adjustable tray 10.

In a preferred embodiment, the platform 12 is constructed on two levels: a first level that supports a mouse or other input device, and a second level lower than the first level through which the fastener 22 passes. This two-tier structure allows the first level to be generally level with the chair arm, so that the user's wrist is approximately straight when using the input device without interference by the fastener 22. Optionally, a wrist pad or cover (not shown) may be placed on the second level to help support the user's wrist.

Figure 3:
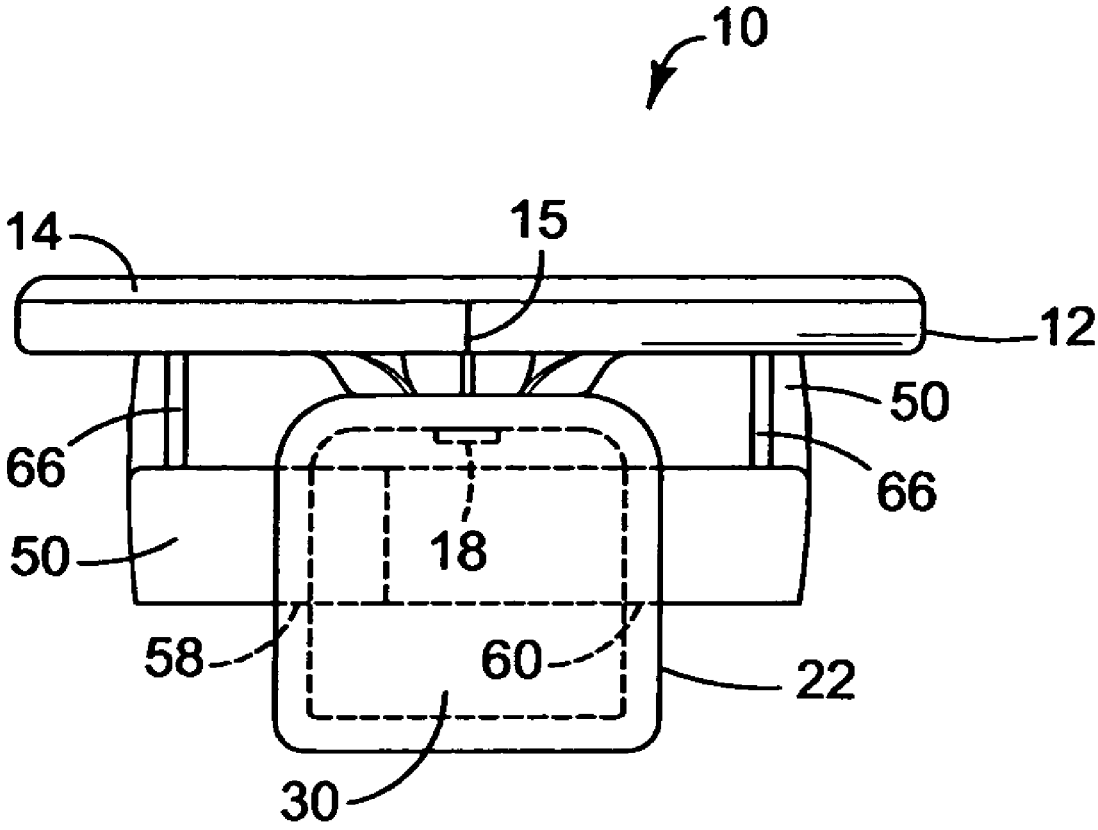
FIG. 3 is a front view of the embodiment of FIG. 1.

FIG. 3 is a front view of the embodiment shown in FIG. 1. Referring to FIGS. 1, 2, and 3, the fastener 18 flexibly secures the platform 12 to armchair stop 22 by passing through the hole 20 in the platform 12, through a slot 28 in the armchair stop 22, and into a cavity 30 (FIG. 3) in armchair stop 22. The slot 28 in the armchair stop 22 has a generally horizontal top leg 32 (FIG. 1) having curved regions on each end and connecting to two generally vertical legs 34 on either side of armchair stop 22 (FIG. 2). The slot 28 has additional generally horizontal side legs 36 on either side of armchair stop 22, terminating in an enlarged hole 38. The shape of slot 28 allows the platform 12 to be positioned on the top of armchair stop 22 for use, or positioned to either side of chair arm 24 by sliding the fastener 22 from horizontal leg 32 into one of vertical legs 34. Vertical legs 34 need not be precisely vertical: they may slope fore and aft or side-to-side to accommodate chair arms of various shapes. Similarly, horizontal side legs 36 need not be precisely horizontal As a result, a person may use the adjustable tray 10 with the platform horizontal and then rotate the platform and the fastener 18 within the slot 28 so that the platform 12 is in a vertical storage position. The transition is easily made by loosening the fastener 18 slightly, and then sliding the fastener 18 and the connected platform 12 within the slot 28 from the horizontal plane to the vertical plane. In another embodiment, the slot 28 has only one vertical leg 34 so that the platform 12 may be stored only on one side of the chair arm 24.

Referring to FIG. 2, the platform 12 may be removed from the armchair stop 22 by sliding the fastener 18 along the leg 36 of the slot 28 to enlarged hole 38. Hole 38 is sufficiently large to allow an end of fastener 18 to pass through, releasing the fastener 18 and the platform 12 from the armchair stop 22.

Figure 4:
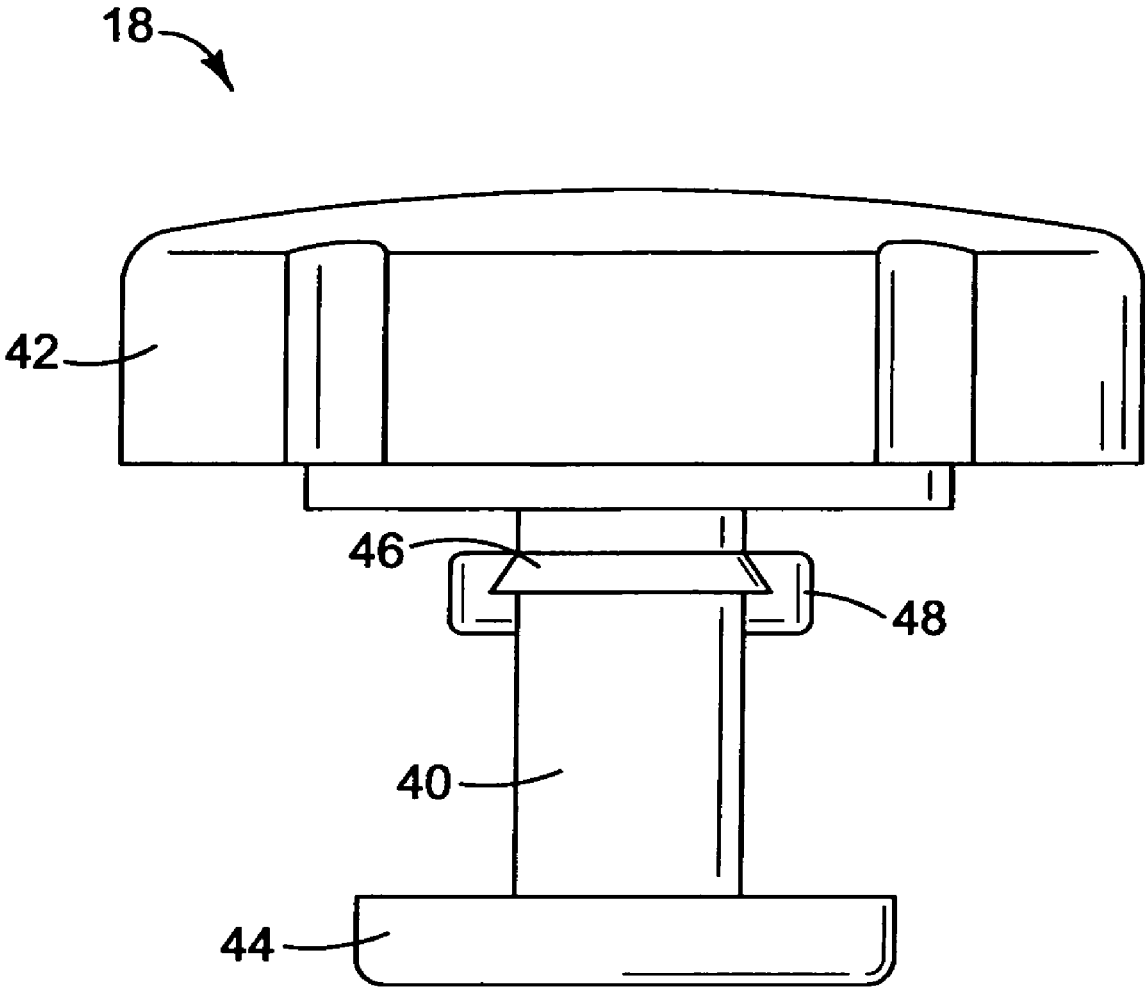
FIG. 4 shows a fastener according to an embodiment of the invention.

The embodiment of the fastener 18 shown in FIG. 4 has a threaded bolt 40 and an ergonomically shaped threaded nut 42. Bolt 40 has a head 44 that is small enough to pass through enlarged hole 38, yet still engage legs 32, 34, and 38 of slot 28. An embodiment of bolt 40 has a frustoconical ring 46 circumvolving the shank of bolt 40 and one or more bosses 48 protruding from the shank of bolt 40.

The hole 20 in the platform 12 may be sized to allow the bolt 40 with the ring 46 to pass through as a press fit. After the ring 46 passes through the hole 20 (FIG. 2), the bolt 40 is captured on the topside of the platform 12 by the ring 46 and on the bottom side by head 44, while still allowed to move a short distance in an axial direction. The hole 20 may optionally be made of a smaller diameter at the upper end, to allow the ring 46 to easily pass through during assembly, while still capturing the bolt 40 during operation. In another embodiment, annular ring may be replaced with one or more barbs.

One or more bosses 48 engage corresponding axial grooves or similar features in the hole 20 to prevent rotation of the bolt 40 relative to the platform 12 when the nut 42 is tightened, eliminating the need for a washer and facilitating tightening of the nut 42 to secure the platform 12. While the bosses 48 are depicted as cylinders, the bosses 48 may be of any shape that engages the grooves and prevents rotation, including a polyhedron or hemisphere.

The adjustable tray 10 further includes one or more guides 50 slidably connected to the armchair stop 22. Viewed from above as shown in FIG. 1, the guides 50 are approximately L-shaped on each end, and one leg of each guide is inserted into a hole 58 and a hole 60 in the armchair stop 22. Holes 58 and 60 are offset, permitting the legs inserted into the slot to be relatively long, accommodating both wide chair arms and narrow chair arms, where the legs overlap each other in the slots. In an embodiment shown in FIG. 5, the rear of the armchair stop 22 may include one or more recesses 64 sized to accommodate guides 50, allowing guides 50 to be adjusted to accommodate a chair arm 24 narrower than armchair stop 22.

Figure 5:
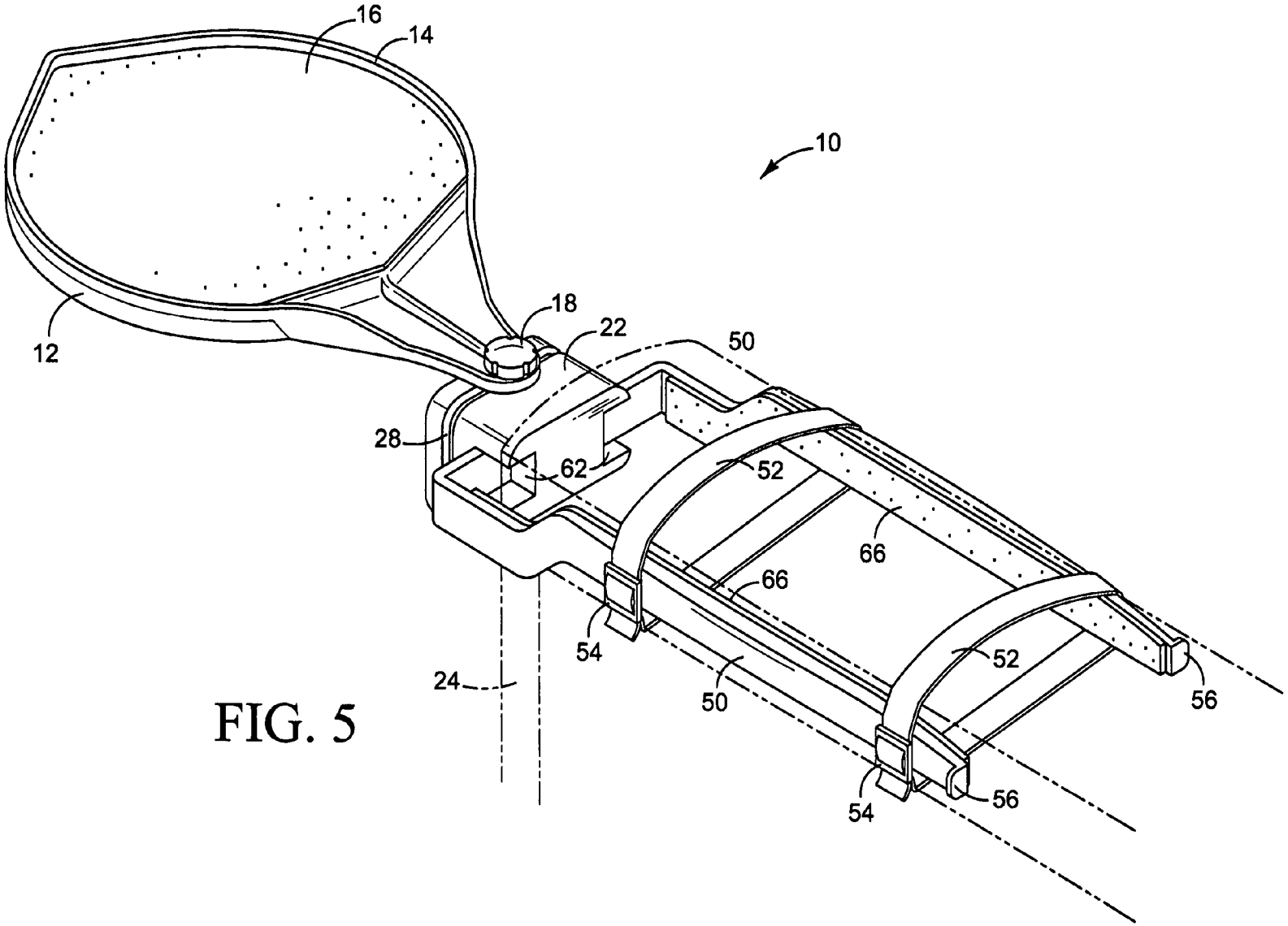
FIG. 5 is a perspective view of another embodiment of the invention.

In a preferred embodiment depicted in FIG. 5, the guides 50 are compressed against the sides of the chair arm by at least one securing device 52. The securing device 52 as herein defined includes, but is not limited to, a clamp, tape, bungee cords, string, tie cords, or straps. Each securing device 52 preferable passes around the chair arm 24 and guides 50 and is preferably fastened by a fastener 54. Fastener 54 may be a Velcro fastener, a Tabler buckle, a clip, or similar buckling device. The compression force of the devices 52 presses the guides 50 against the chair arm and into the armchair stop, effectively securing the adjustable tray 10. This embodiment provides the advantage of simplicity and allows the adjustable tray 10 to be quickly and easily mounted to the chair arm with ease.

Another embodiment may include at least one strap slot or loop in each guide 50 in which to thread the securing devices 52 to compress and secure the guides 50 to the chair arm. The strap slots preferably run a substantial length of the guides 50 allowing the securing devices 52 to be slid or moved to accommodate the configuration of the chair arm and particularly the support members.

In a preferred embodiment, the guides 50 each have a tab 56 on the end furthest from the armchair stop 22 to prevent securing devices 52 from slipping off the ends of guides 50. Guides 50 may also be tapered to better conform to curved chair arms.

Referring to FIG. 3, the guides 50 curve downward in the region 64 nearest the armchair stop 22 so that the platform 12 is approximately level with the uppermost surface of guides 50. Without the curved region 64, the platform 12 would be positioned above the chair arm 24, causing the user's wrist to flex upward when using a mouse or other input device, potentially causing carpal tunnel stress within the wrist. In another embodiment, a deeper curve positions the platform 12 below the chair arm 24, which may be comfortable for some users. Curved region 64 need not be smoothly curved in the S-shape shown; it may descend sharply in a Z-shape or with perpendicular angles.

Adjustable tray 10 may include multiple sets of guides 50, each set tapered, curved, and including features that best fit a class of chair arms. The user may then select the set of guides that best fits the user's chair.

The armchair stop 22, the guides 50, and the securing devices 52 are preferably lined with a cushioning material 66. The cushioning material 66 allows the guides 50 and the armchair stop 22 to be tightened against the surface of a chair without scratching or other marring of the chair. Cushioning material 66 also provides a non-slip surface that prevents movement during the use of the adjustable tray 10. Cushioning material 66 may be any material such as rubber, plastic or cloth that prevents slippage and marring of the arm of the chair. In a preferred embodiment, the cushioning material 66 is neoprene or other non-skid rubberized material used to form traditional stand-alone mouse pads.

While there is shown and described the present preferred embodiments of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An adjustable tray for use on a chair arm having a top surface and a width dimension, comprising:

an armchair stop;

a platform having a generally planar working surface and defining a securing hole;

a fastener having body and a head, the body passing through the securing hole into the armchair stop, wherein the platform is rotatably connected to the armchair stop by the fastener, and wherein the platform is movable from an approximately horizontal plane to an approximately vertical plane;

an elongated guide adjustably connected to the armchair stop, wherein the elongated guide supports the armchair stop, the elongated guide is adjustable to fit the adjustable tray to the width dimension of the chair arm, and the elongated guide has a first end and a second end;

a compression element circumvolving the chair arm and the elongated guide to compress and secure the elongated guide to the chair arm;

a generally horizontal surface defining a first slot, the first slot adapted to retain the head of the fastener and to allow the body of the fastener to pass therethrough; and a generally vertical surface in contact with the top surface and defining a second slot, the second slot connected to the first slot and adapted to retain the head of the fastener and to allow the body of the fastener to pass therethrough;

wherein the rotational fastener passes from the first slot to the second slot and vice-versa, allowing the platform to be positioned in an approximately horizontal plane and an approximately vertical plane.

2. The adjustable tray of claim 1, wherein the vertical surface further defines:

a third slot in the side surface, the third slot connected to the second slot and adapted to allow the body of the fastener to pass therethrough and adapted to retain the head of the fastener; and an enlarged hole connected to the third slot and adapted to allow the head of the fastener to pass therethrough;

whereby the platform may be released from the armchair stop by passing the fastener through the third slot and passing the head through the enlarged hole.

3. The adjustable tray of claim 1, wherein the armchair stop further defines a hole adapted to receive the first end of the elongated guide, and wherein the first end of the elongated guide is slideable within the hole to adjust the adjustable tray to fit the width dimension of the chair arm.

4. The adjustable tray of claim 1, wherein the elongated guide further defines at least one slit; wherein the compression element passes through the slit to secure the elongated guide to the chair arm.

5. The adjustable tray of claim 1, wherein the generally planar working surface is approximately level with the top of the chair arm.

6. The adjustable tray of claim 5, wherein the elongated guide is shaped in an S-curve to maintain the generally planar working surface approximately level with the top of the chair arm.

7. The adjustable tray of claim 1, wherein the elongated guide further comprises a tab connected to the second end, wherein the tab is adapted to keep the compression element between the first end and the second end.

8. The adjustable tray of claim 1, wherein the compression element is a strap.

9. The adjustable tray of claim 8, further comprising a hook and loop style fastener.

10. The adjustable tray of claim 1, further comprising a retainer affixed to the platform for preventing a mouse pad surface and other devices from slipping off the platform during use and storage.

11. The adjustable tray of claim 1, further comprising a cushioning material disposed on the platform, on the elongated guide, and on the armchair stop.

12. The adjustable tray of claim 1, wherein the platform defines a perimeter shaped generally as an oval.

13. The adjustable tray of claim 12, wherein the perimeter defines a region converging more sharply than an oval, whereby the converging region tends to urge the platform aside when the platform comes in contact with an obstacle.

14. The adjustable tray of claim 1, wherein the fastener body comprises a threaded shank and the fastener further comprises a threaded nut fastenable on the threaded shank and having no sharp edges when fastened to the shank.

15. An adjustable tray for use on a chair arm having a top surface and a width dimension, comprising:

a platform having an approximately generally planar working surface and defining a securing hole;

a fastener having a body and a head, the body passing through the securing hole;

an armchair stop having a top surface and a side surface, the armchair stop defining:

a first hole in the side surface;

a first slot in the top surface, the first slot adapted to retain the head of the fastener and to allow the body of the fastener to pass therethrough; and a second slot in the side surface, the second slot connected to the first slot and adapted to retain the head of the fastener and to allow the body of the fastener to pass therethrough;

wherein the platform is rotatably connected to the armchair stop by the fastener, and wherein the fastener is movable within the first slot to place the platform in a horizontal plane, and movable within the second slot to place the platform in a vertical plane;

a guide comprising a body and a leg connected to the body at a generally perpendicular angle, wherein the guide is adjustably connected to the armchair stop by placing a portion of the leg into the first hole; and a compression element circumvolving the chair arm and the elongated guide to compress and secure the elongated guide to the chair arm.

16. The adjustable tray of claim 15, wherein the working surface is approximately level with the top of the chair arm.

17. An adjustable tray, for use on a chair arm having a top and defining a width, comprising:

a platform comprising:

a planar working surface having a curved perimeter, the perimeter defining a peak wherein the peak serves to urge the platform aside when the platform contacts an obstacle; and a second surface offset from the plane of the first surface and defining a securing hole;

a fastener;

an armchair stop comprising:

a body having an approximately horizontal top, an approximately vertical first side, and an approximately vertical second side;

an elongated slot in the top, the first side, and the second side;

a cavity, wherein the platform is rotatably connected to the armchair stop by the fastener, and wherein the fastener passes through the securing hole, through the elongated slot, and into the cavity, allowing the fastener to pass along the slot to place the platform in a horizontal plane and in a vertical plane;

a first hole in the first side; and a second hole in the second side, offset from the first hole;

a first guide comprising a first leg insertable in the first hole and a second leg adapted to conform to the chair arm;

a second guide comprising a third leg insertable in the second hole and a fourth leg adapted to conform to the chair arm;

a compression element capable of passing around the first and second guides and the chair arm to secure the first and second guides to the chair arm, whereby the first leg and third leg of the first and second guides, respectively, are insertable into the first and second holes a distance appropriate to accommodate the width of the chair arm, and holding the armchair stop and platform so that the working surface is approximately level with the top of the chair arm when the first and second guides are secured to the chair arm.

18. An adjustable tray for use on a chair arm having a top surface and a width dimension, comprising: an armchair stop, wherein the armchair stop further defines a hole adapted to receive a first end of an elongated guide, and wherein the first end of the elongated guide; a platform having a generally planar working surface and defining a securing hole; a fastener having body and a head, the body passing through the securing hole into the armchair stop, wherein the platform is rotatably connected to the armchair stop by the fastener, and wherein the platform is movable from an approximately horizontal plane to an approximately vertical plane; an elongated guide adjustably connected to the armchair stop, wherein the elongated guide supports the armchair stop, and the elongated guide has a first end and a second end, wherein the first end of the elongated guide is slideable within the armchair stop hole to adjust the adjustable tray to fit the width dimension of the chair arm; and a compression element circumvolving the chair arm and the elongated guide to compress and secure the elongated guide to the chair arm.

19. An adjustable tray for use on a chair arm having a top surface and a width dimension, comprising:

an armchair stop;

a platform having a generally planar working surface that is approximately level with the top of the chair arm, said planar working surface defining a securing hole;

a fastener having body and a head, the body passing through the securing hole into the armchair stop, wherein the platform is rotatably connected to the armchair stop by the fastener, and wherein the platform is movable from an approximately horizontal plane to an approximately vertical plane; and an elongated guide adjustably connected to the armchair stop, wherein the elongated guide supports the armchair stop, the elongated guide is adjustable to fit the adjustable tray to the width dimension of the chair arm, and the elongated guide has a first end and a second end, said elongated guide shaped in an S-curve to maintain the generally planar working surface approximately level with the top of the chair arm.

* * * * *